US009097480B2

(12) United States Patent
Keng

(10) Patent No.: US 9,097,480 B2
(45) Date of Patent: Aug. 4, 2015

(54) MAGAZINE FLOORPLATE MONOPOD ATTACHMENTS FOR FIREARMS

(71) Applicant: Multitasker Tools LLC, Marietta, GA (US)

(72) Inventor: Shane Keng, Marietta, GA (US)

(73) Assignee: MULTITASKER TOOLS LLC, Marietta, GA (US)

( * ) Notice: Subject to any disclaimer, the term of this patent is extended or adjusted under 35 U.S.C. 154(b) by 0 days.

(21) Appl. No.: 14/081,664

(22) Filed: Nov. 15, 2013

(65) Prior Publication Data

US 2014/0068992 A1 Mar. 13, 2014

Related U.S. Application Data

(63) Continuation-in-part of application No. 13/366,784, filed on Feb. 6, 2012, now Pat. No. 8,590,202.

(60) Provisional application No. 61/739,366, filed on Dec. 19, 2012, provisional application No. 61/439,370, filed on Feb. 4, 2011, provisional application No. 61/500,534, filed on Jun. 23, 2011.

(51) Int. Cl.

| | |
|---|---|
| ***F41C 27/22*** | (2006.01) |
| ***F41A 23/02*** | (2006.01) |
| ***F41A 9/65*** | (2006.01) |
| ***F41A 23/08*** | (2006.01) |
| ***F41A 23/04*** | (2006.01) |

(52) U.S. Cl.

CPC . *F41A 23/02* (2013.01); *F41A 9/65* (2013.01); *F41A 23/04* (2013.01); *F41A 23/08* (2013.01)

(58) Field of Classification Search

CPC ..... F41A 23/10; F41A 23/16; F41A 23/18; F41A 23/04; F41A 9/65; F41C 23/14; F41C 27/00; F41C 23/12; F41C 27/22

USPC ..... 42/94, 90, 74, 50, 71.02; D22/108

See application file for complete search history.

(56) References Cited

U.S. PATENT DOCUMENTS

| | | | | |
|---|---|---|---|---|
| D344,780 | S * | 3/1994 | Jenkins | D22/108 |
| 6,698,127 | B2 * | 3/2004 | Weber | 42/71.02 |
| D593,634 | S * | 6/2009 | Fitzpatrick et al. | D22/108 |
| D642,647 | S * | 8/2011 | Fitzpatrick et al. | D22/108 |
| D680,613 | S * | 4/2013 | Fitzpatrick et al. | D22/108 |
| 2010/0154275 | A1 * | 6/2010 | Faifer | 42/90 |
| 2012/0167430 | A1 * | 7/2012 | Freed | 42/71.02 |

* cited by examiner

*Primary Examiner* — Samir Abdosh
*Assistant Examiner* — John D Cooper
(74) *Attorney, Agent, or Firm* — Sutherland Asbill & Brennan LLP

(57) ABSTRACT

A shooting rest is disclosed herein. The shooting rest may include a magazine floor coupling configured to couple to a bottom portion of a firearm magazine. The shooting rest also may include a lower extension extending downward from the magazine floor coupling. The lower extension may include a forward portion comprising at least one point of contact for supporting or stabilizing the shooting rest. The lower extension also may include a rearward portion comprising at least two points of contact for supporting or stabilizing the shooting rest. The forward portion may include a length greater than the rearward portion.

15 Claims, 17 Drawing Sheets

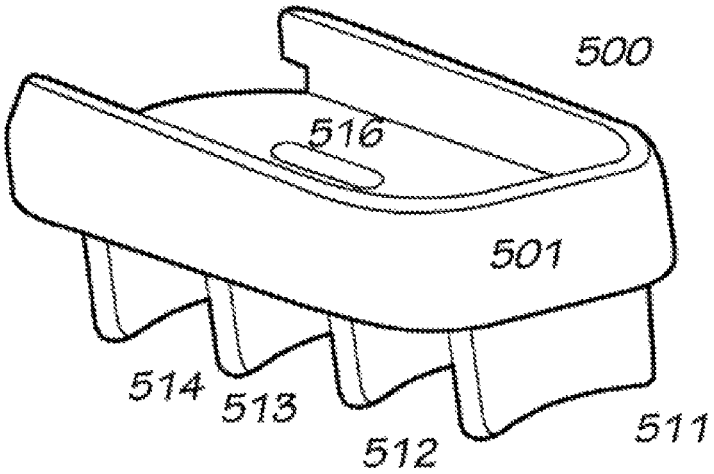
FIG. 8A
FIG. 8B
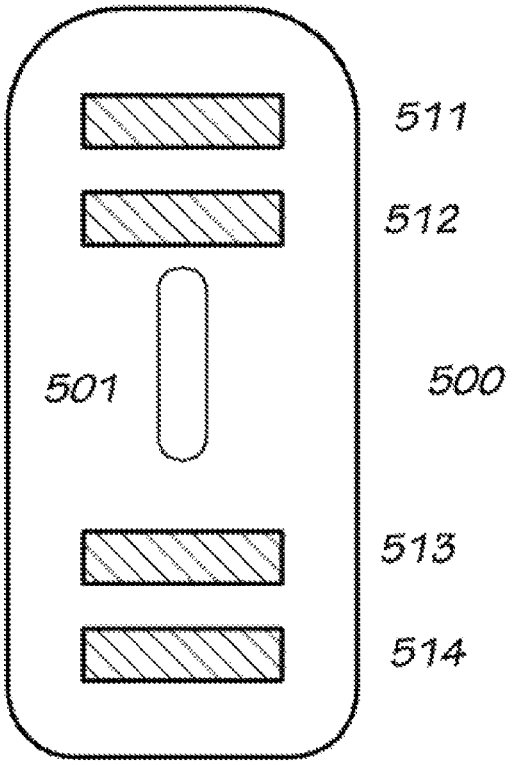

MAGAZINE FLOORPLATE MONOPOD ATTACHMENTS FOR FIREARMS

CROSS-REFERENCE TO RELATED APPLICATIONS

The present application claims priority to and the benefit of U.S. Provisional Patent Application No. 61/739,366, filed Dec. 19, 2012, which is hereby incorporated by reference in its entirety. Moreover, the present application claims priority to, the benefit of, and is a continuation-in-part of U.S. patent application Ser. No. 13/366,784, filed Feb. 6, 2012, which claims priority to and the benefit of U.S. Provisional Patent Application No. 61/439,370, filed Feb. 4, 2011, and U.S. Provisional Patent Application No. 61/500,534, filed Jun. 23, 2011, which are all hereby incorporated by reference in their entirety.

FIELD OF THE DISCLOSURE

The present application relates to shooting rest attachments for firearms and more particularly to magazine floorplate monopod attachments for firearms.

BACKGROUND

It is an advantage to use a stabilizing support when shooting, particularly if the target is far away. Movement while aiming can cause significant shifts in the point of impact downrange, so it is desirable to stabilize the firearm as much as possible when shooting. Conventional shooting rests for firearms in the form of bipods or monopods are known in the prior art. For example, U.S. Pat. No. 7,669,357 to Moody et al, U.S. Pat. No. 7,478,496 to Bender, U.S. Pat. No. 7,197,844 to Benson, U.S. Pat. No. 7,124,528 to Long, U.S. Pat. No. 5,377,437 to Underwood and U.S. Pat. No. 4,393,614 to Pickett are all illustrative of the prior art.

While these inventions accomplish the task of stabilizing a firearm for improved accuracy, these devices add a significant amount of additional weight and bulk in order to provide the desired function. Likewise, said devices require some form of manipulation by the user prior to being used. Furthermore, due to the complexity of parts or materials used, the cost of manufacturing can be quite high. Accordingly, there exists a need in the art for a low cost and reliable shooting rest.

BRIEF DESCRIPTION OF THE DRAWINGS

Reference will now be made to the accompanying drawings, which are not necessarily drawn to scale, and wherein:

FIG. 8A is a perspective view of the monopod shooting rest according to an embodiment.

FIG. 8B is a bottom view of the monopod shooting rest according to an embodiment.

DETAILED DESCRIPTION

Illustrative embodiments will now be described more fully hereinafter with reference to the accompanying drawings, in which some, but not all embodiments are shown. The present application may be embodied in many different forms and should not be construed as limited to the embodiments set forth herein. Like numbers refer to like elements throughout.

According to an embodiment, an aspect of the present application is to provide a stable monopod shooting rest device at the base of a magazine fed firearm. The monopod shooting rest improves upon the prior art by being significantly smaller, lighter, and cheaper to manufacture. Also, the monopod shooting rest is always in the deployed position and requires no additional manipulation prior to use.

In certain aspects, the monopod shooting rest may be coupled to the magazine body without modify the existing attachment point in the magazine. For example, FIGS. 4-11C all illustrate various embodiments of a support structure for the firearm, in the form of a monopod shooting rest, which may replace the floorplate section of the magazine. In other aspects, the monopod shooting rest may be composed, at least in part, of one or more materials such as, but not limited to, reinforced nylon, ABS plastic, santoprene, synthetic santoprene, silicone, rubber, or the like, a combination thereof, or any suitable material for providing grip or traction when in use. The monopod shooting rest can be molded, overmolded, cast, or machined as an integral part of the floorplate replacement section, or it can be manufactured as a separate component and attached to the magazine, such as by fasteners or industrial adhesive.

Figure 1:
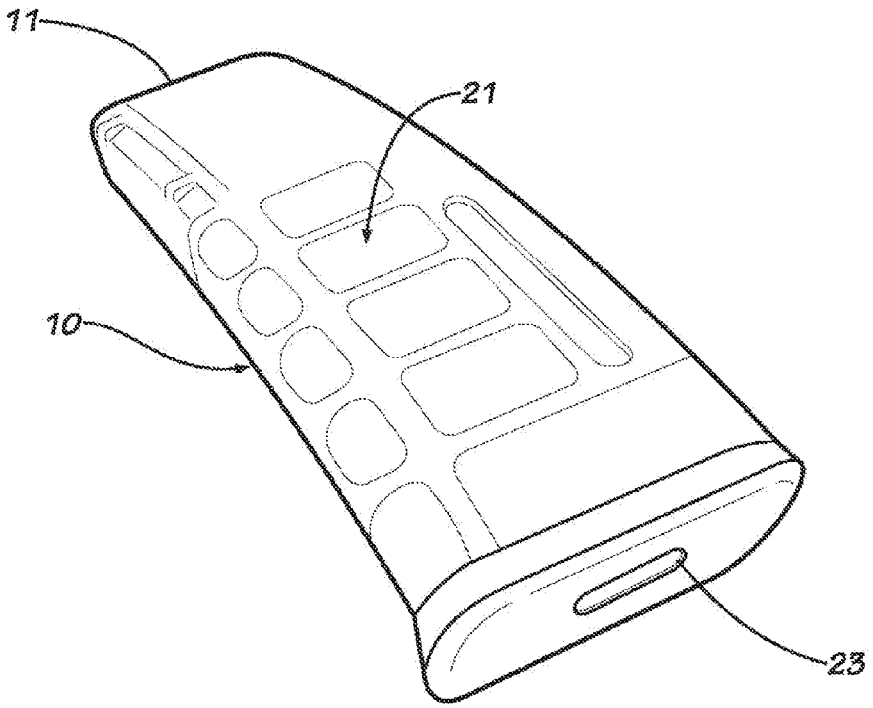
FIG. 1 is a perspective view of a box magazine for the M-16 rifle.
Figure 2:
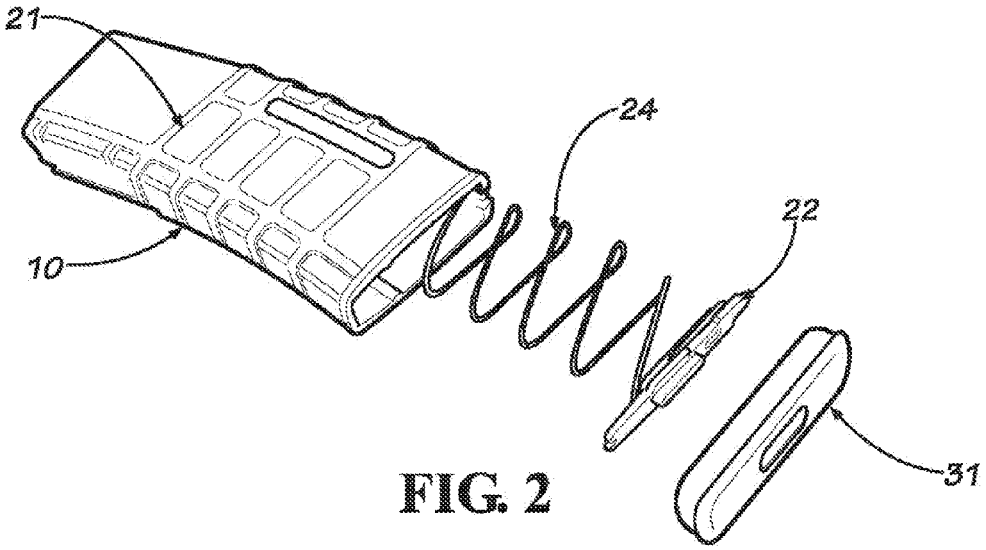
FIG. 2 is an exploded view of the magazine in FIG. 1.

The generic box fed magazine is a device that has been widely used to feed ammunition into firearms. The basic structure of the M16/AR box magazine 10, for example, is depicted in FIG. 1. The outer case of the magazine 21 is shaped to hold ammunition in a vertically stacked arrangement. The magazine includes a feed side 11, which dispenses ammunition into the feed mechanism of the firearm, and an end or floor side, which is covered by the floorplate 23. FIG. 2 is an exploded view of the box magazine referenced in FIG. 1 and depicts a magazine spring 24 and a magazine spring guide 22 that seats into a cutout 31 on the floorplate 23. Example box magazines may include the MagPul PMAG and/or the USGI 30-rd. One of ordinary skill in the art, however, will appreciate that the shooting rest discussed herein may be attached to the bottom portion of any box magazine known in the art by any means.

Figure 3A:
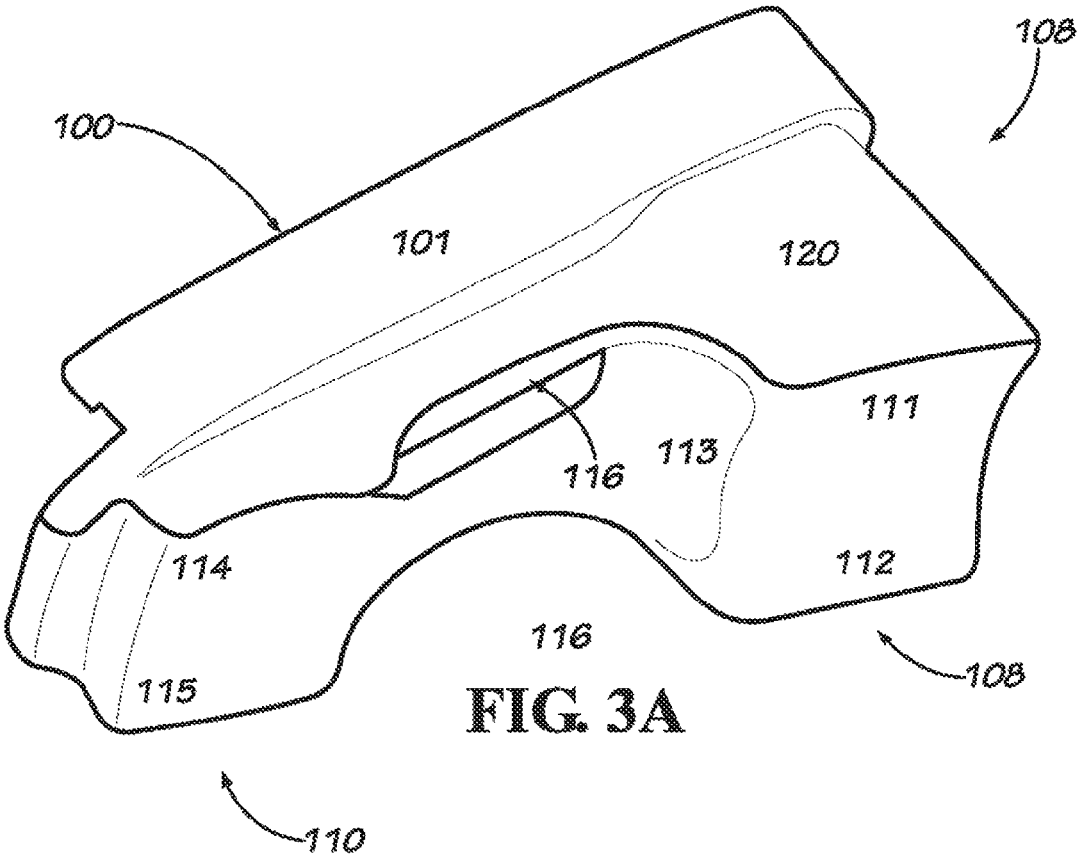
FIG. 3A is a perspective of the monopod shooting rest according to an embodiment.
Figure 3B:
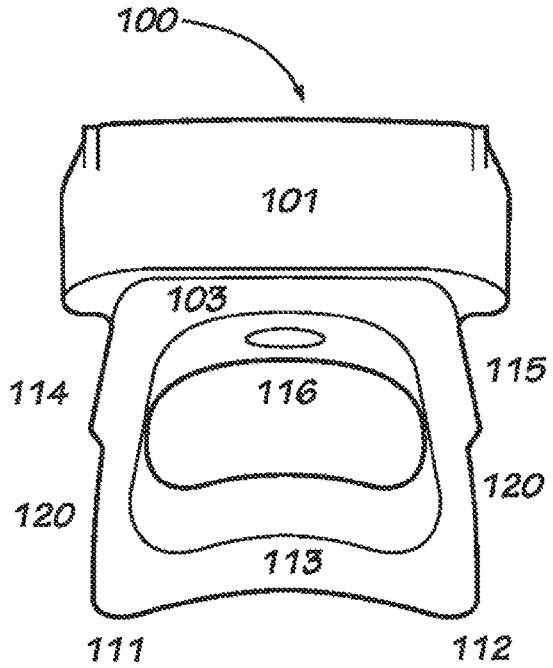
FIG. 3B is a frontal view of the monopod shooting rest according to an embodiment.
Figure 4:
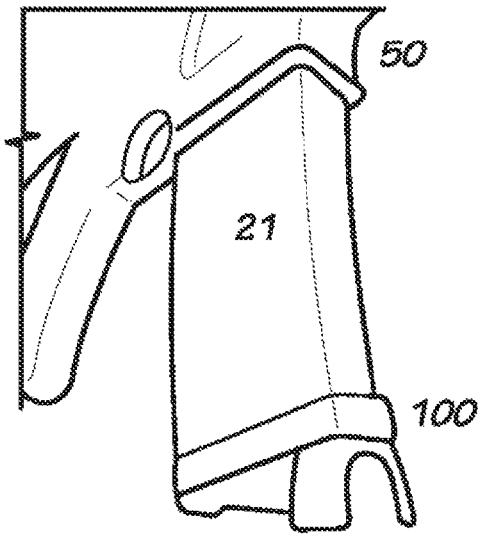
FIG. 4 is a perspective view of the monopod shooting rest installed as the replacement for the floorplate of the magazine in FIG. 1 according to an embodiment.

As shown in FIGS. 3A and 3B, an embodiment of a monopod shooting rest 100 may incorporate the replacement coupling for the magazine floorplate 23 in FIG. 1 as an integral part of its structure. Alternatively, the base of the structure may be fastened, such as by screws, adhesive or other suitable means, to an existing baseplate. The shooting rest 100 shown in FIG. 3A may be configured to be attached to the base of the box magazine in place of the standard floorplate with no additional modifications. FIG. 3A shows the replacement floorplate coupling 101 and a cutout 116 for seating the magazine spring guide. Other embodiments of the floorplate coupling 101 may not include the cutout 116; instead, the floorplate coupling 101 may include a similar configuration for attachment to the base of the box magazine as the floorplate it is intended to replace. The mounting method insures that the magazine spring and follower will function exactly the same as with the stock floorplate. Substantially adjacent to the floorplate coupling 101 is an extension 106, which forms a support section. The extension 106 may be comprised of differing suitable shapes, including extending a plurality of sides and molding them together. Due to the curvature of most box fed magazines, an element of the design is that a front portion 108 of the extension 106 be taller than a rear portion 110, so as to maintain the optimum muzzle pitch when the magazine is inserted into the firearm. The front portion 108 of extension 106 may be rolled to form small points 111 and 112, which serve to act as feet (contact points or surfaces) in anchoring the shooting rest into the ground. A lateral reinforcement bar 113 is provided between points 111 and 112 preferably with a slight arch to help create the spike effect which will aid with stability and prevent sliding along the ground. FIG. 3B is a frontal view of the shooting rest 100 which shows the pronounced arch formed by the lower lateral reinforcement bar 113 and also indicates an upper reinforcement bar 103 that is formed by creating a void between the upper and lower bars 113 and 103. The walls forming the cavity may be molded, cast, or machined and serve to lighten the device while providing greater structural support. A dimple 120 may be placed on either side of the forward edge to help provide a grabbing point for manipulating the shooting rest when the firearm is deployed, as illustrated in FIG. 4.

The rearward part of extension 106 may be tapered and also rolled to form small points 114 and 115 which will also create a spike like effect to aid stability. The edges of the points 111, 112, 114, and 115 may be radiused and/or rounded so as not to create sharp edges which could snag on other equipment or brush.

Figure 5:
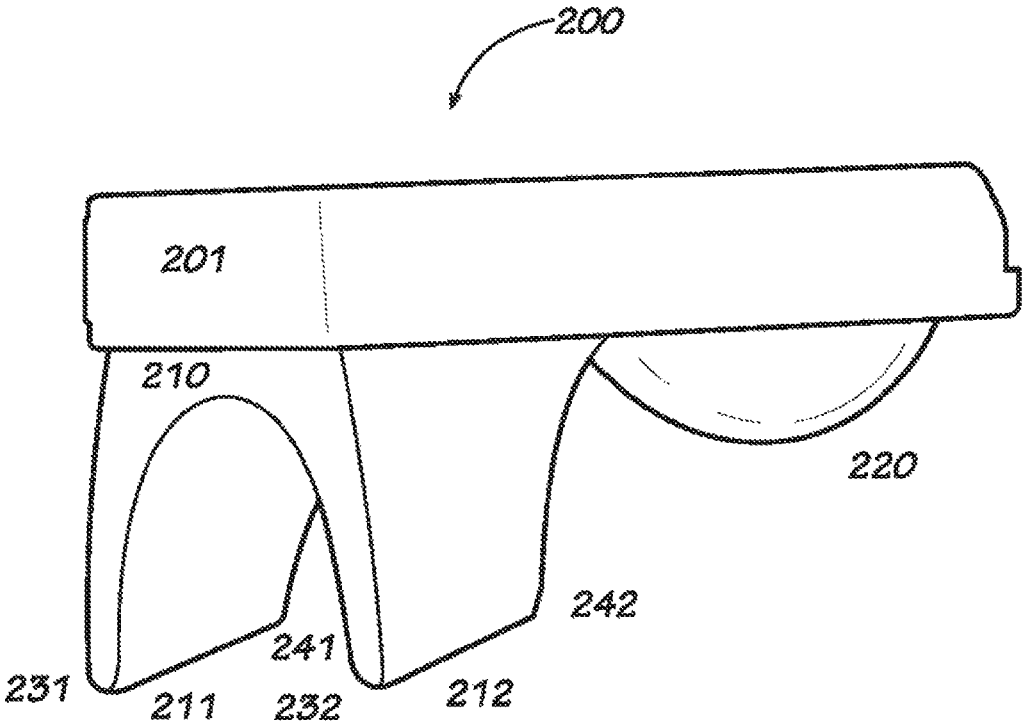
FIG. 5 is a perspective view of the monopod shooting rest according to an embodiment.

FIG. 5 shows an embodiment of the shooting rest 200 in accordance with an embodiment. In this embodiment, a magazine floor coupling 201 that is substantially identical to the standard floorplate is provided, as depicted in FIGS. 3A-3B. A forward extension 210 at a first end of the shooting rest 200 may include two equal sized protrusions 211 and 212 that extend downward to create the forward feet (contact points or surfaces) of the shooting rest 200. These protrusions may have slightly radiused and/or rounded corners along the leading edges 231 and 232 as well as the trailing edges 241 and 242 to prevent snagging on other equipment or objects. A rear extension 220 may include a spherical shape to allow for the shooting rest 200 to pivot along multiple axis, with two points of contact, if the shooter decides to cant or tilt the firearm. The rear extension 220 may be shorter in height relative to the front protrusions 211 and 212 to provide a desired muzzle pitch when the magazine is inserted into the firearm. The rear extension 220 may be serrated or have some other form of texturing to give it more traction on the surface.

Figure 6A:
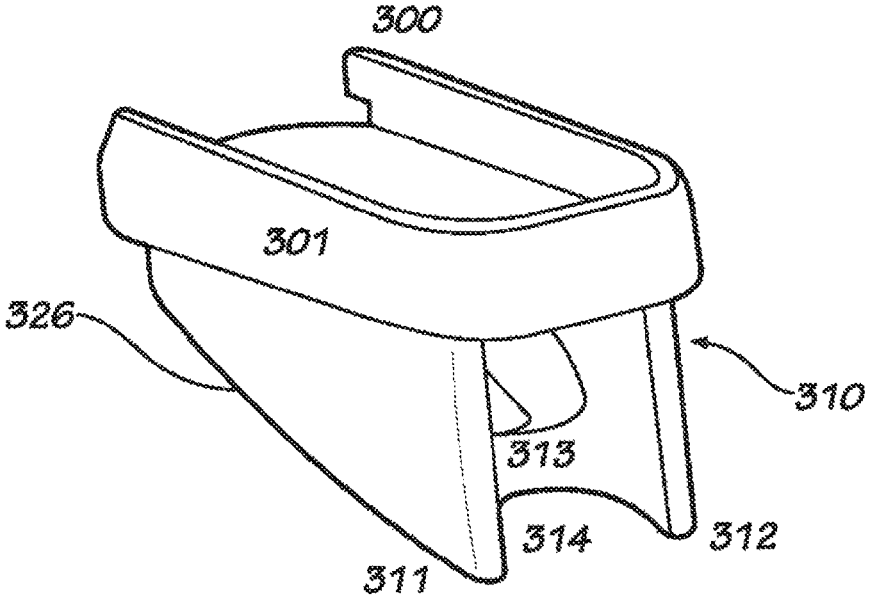
FIG. 6A is a perspective view of the monopod shooting rest according to an embodiment.
Figure 6B:
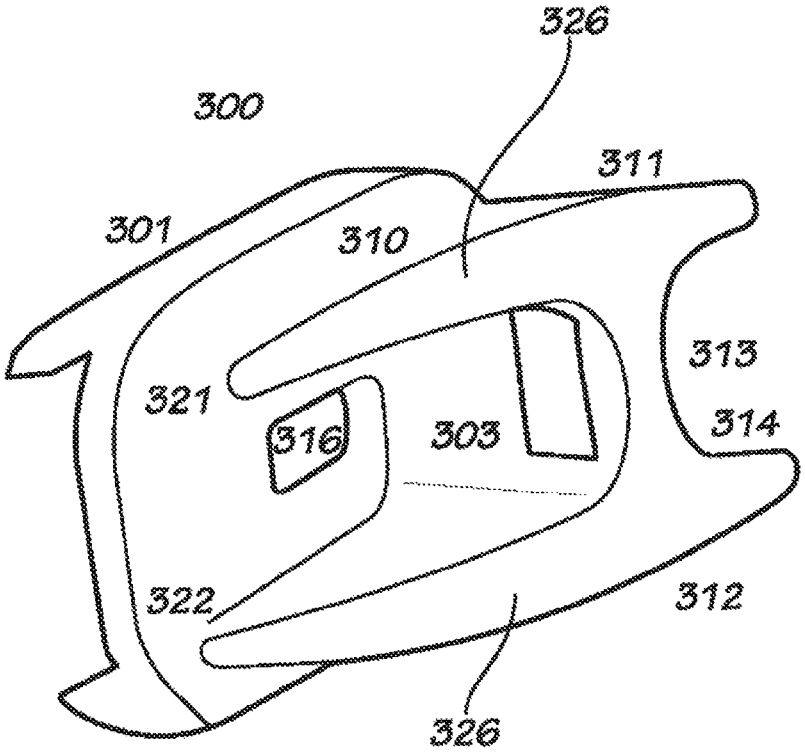
FIG. 6B is a perspective view of the monopod shooting rest according to an embodiment.

FIGS. 6A and 6B depict a shooting rest 300 in accordance with an embodiment. In this embodiment, a magazine floor coupling 301 that is substantially identical to the standard floorplate is provided, as depicted in FIGS. 3A and 3B. In this embodiment, the lower extension 310 may comprise two equal length side runners 311 and 312 that run along the outer edge of the floor coupling 301, thereby creating the effect of dual feet to stabilize the firearm when the magazine is in use. The height of 311 and 312 may decrease progressively from a front end to a rear end in order to provide a desired muzzle pitch when the magazine is inserted into the firearm. The lower edges 326 of the runners 311 and 312 may be acute in a convex or concave configuration. Connecting the side runners 311 and 312 are two horizontal arrayed cross-members 303 and 313. The upper cross-member 303 and the lower cross-member 313 serve as structural reinforcements for the side runners 311 and 312. In between the cross-members 303 and 313 is a weight reduction cavity which can be formed by molding, casting or machining. The lower cross-member 313 may be arched upward along its lower edge 314 so the cross-member 313 does not come in contact with the ground when in use.

Figure 7A:
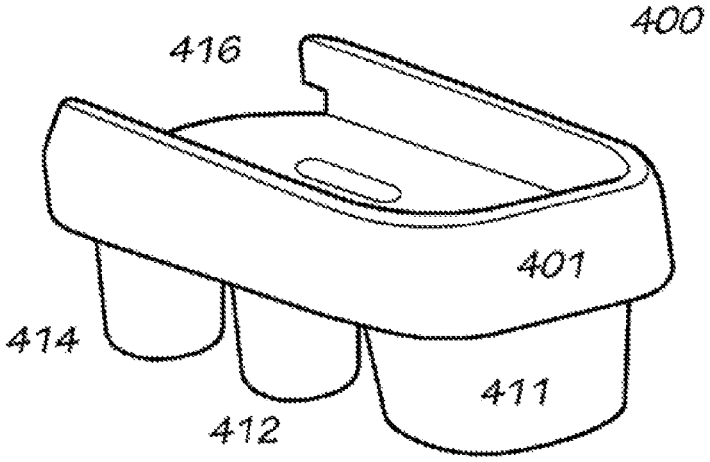
FIG. 7A is a perspective view of the monopod shooting rest according to an embodiment.
Figure 7B:
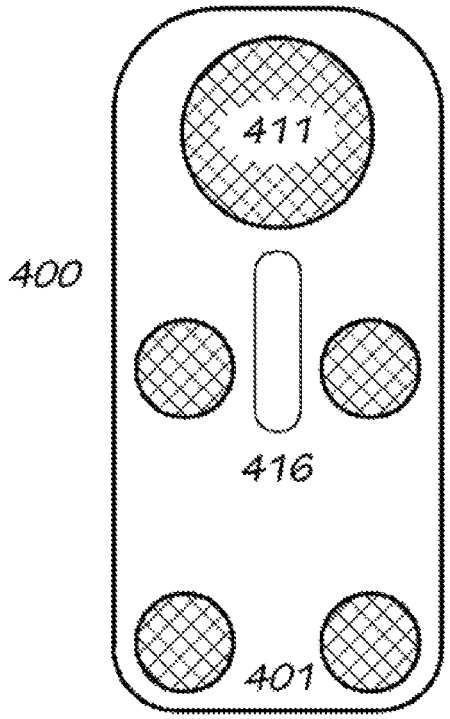
FIG. 7B is a bottom view of the monopod shooting rest according to an embodiment.

FIGS. 7A and 7B depicts a shooting rest 400 in accordance with an embodiment. In this embodiment, a magazine floor coupling 401 that is substantially identical to the standard floorplate is provided, as in the embodiment of FIGS. 3A and 3B. As shown in FIG. 7A, the lower extension of shooting rest 400 may comprise a plurality of posts 412, 413, 414, and 415. In certain aspects, the front post 411 may be the largest and tallest, then four posts 412, 413, 414 and 415 may be arrayed in two parallel rows behind the front post 411 in descending height from front posts 412 and 413 to rear posts 414 and 415 to provide a desired muzzle pitch when the magazine is in use. FIG. 7B is a bottom view which shows the array of posts 412, 413, 414, and 415. In some instances, the bottom surface of each post 411, 412, 413, 414, 415 may be imprinted or cast with a knurled texture to provide better contact with the ground. While illustrated with a circular cross-section, the post may take other suitable shapes, such as triangular, oval, star, or the like, and may be of any desired height.

FIGS. 8A and 8B depict a shooting rest 500 in accordance with an embodiment. In this embodiment, a magazine floor coupling 501 that is substantially identical to the standard floorplate is provided as in the embodiment of FIGS. 3A and 3B. FIG. 8A is a perspective view of the shooting rest 500 having a plurality of rows of horizontally arrayed cross-members 511, 512, 513, and 514. The rows 511, 512, 513, and 514 may be in progressively descending height in order to provide a desired muzzle pitch when the magazine is in use. The distal ends of cross-members 511, 512, 513, and 514 may be arched upward to form a spike effect on the outer edge of each cross-members 511, 512, 513, and 514, providing better contact with the ground. The bottom surface of cross-members 511, 512, 513, and 514 may be knurled or serrated to provide more secure contact with the ground. While four rows are provided in shooting rest 500, any configuration with two or more rows may be suitable.

Figure 9A:
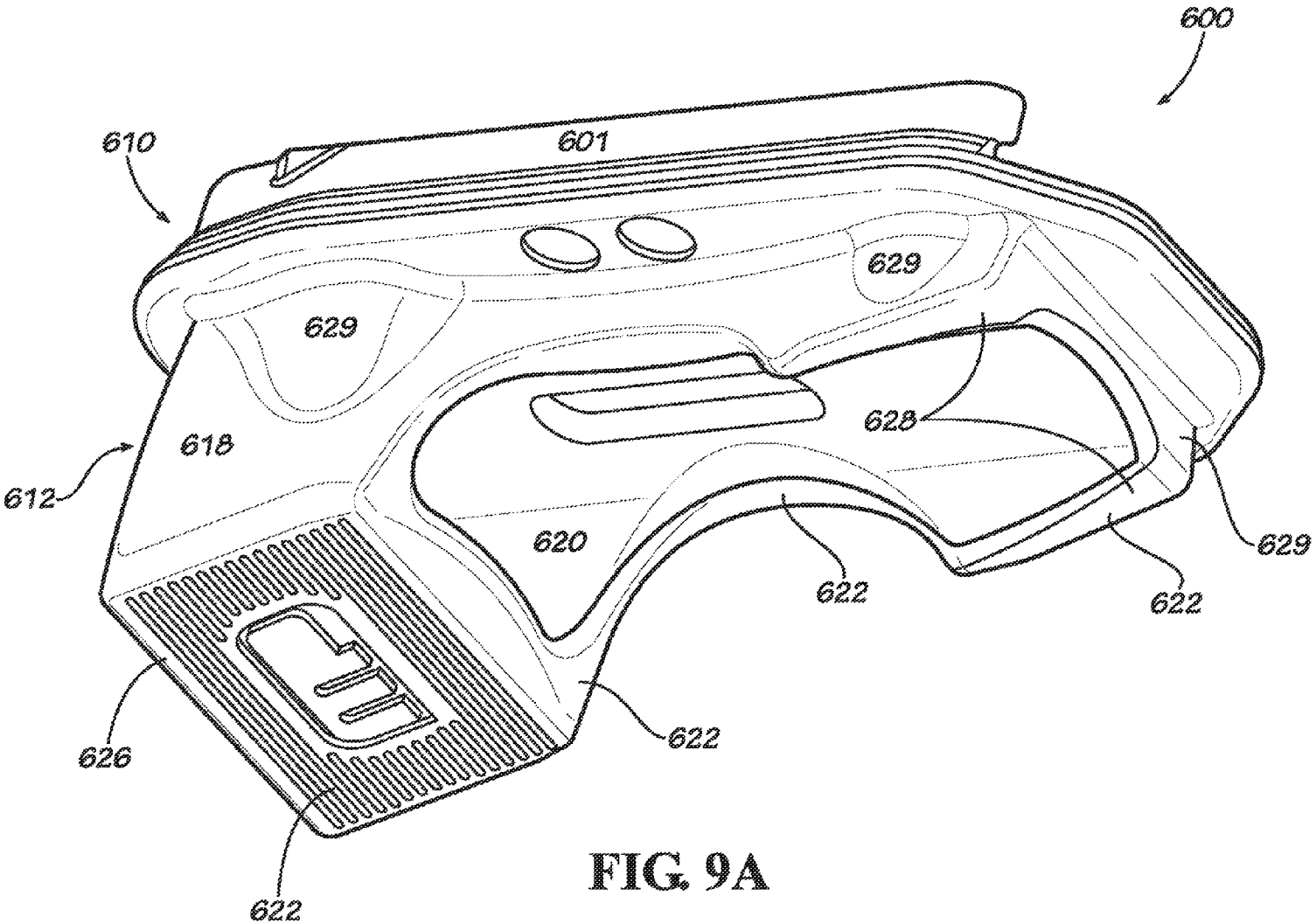
FIG. 9A is a perspective view of the monopod shooting rest according to an embodiment.

FIGS. 9A-9D depict a shooting rest 600 in accordance with an embodiment. In this embodiment, a magazine floor coupling 601 that is substantially identical to the standard floorplate is provided as in the embodiment of FIGS. 3A-3B. FIG. 9A is a perspective view of the shooting rest 600 having an upper extension 610 and a lower extension 612. The upper extension 610 may be molded to be wider, at least in part, than the lower extension 612 such that the appropriate structural strength is provided to the shooting rest 600. The upper section 610 may also include one or more index marks 614 and 616 on either side of the bottom exterior portion. Index marks 614 and 616 may be used for color coding or otherwise identifying the shooting rest 600, such as by a user or owner. Index marks 614 and 616, however, may be placed anywhere on the shooting rest 600. The lower extension 612 may comprise two equal length (and/or similarly shaped) side runners 618 and 620 that run along the outer edge of the floor coupling 601, thereby creating the effect of three or four feet (contact points or surfaces) to stabilize the firearm when the magazine is in use. The height of side runners 618 and 620 may decrease progressively from a front end to a rear end in order to provide a desired muzzle pitch when the magazine is inserted into the firearm.

The lower edges 622 may be acute in a convex or concave configuration. Additionally, the lower edges 622 may be formed in a shape similar to a lower case letter "r" or similar to a lower edge 326 of FIG. 6A but with a semi-ovular shape removed. Connecting the side runners 618 and 620 are two horizontal arrayed cross-members 624 and 626. The rear cross-member 624 and the front cross-member 626 may serve as structural reinforcements for the side runners 618 and 620. Additionally, the front cross-member 626 may be placed substantially horizontally to act as a contact with the ground when the firearm is being fired from a prone position. In some embodiments, the front cross-member 626 may be formed, at least in part, of a material such as, but not limited to, reinforced nylon, ABS plastic, santoprene, synthetic santoprene, silicone, rubber, a combination thereof, or the like, or any suitable material for providing grip or traction when in use. The bottom portions 628 of side runners 618 and 620 may also be made of any similar material, such as santoprene, or the like. Further, the bottom portions 628 and/or the bottom of the front cross-member 626 may be configured with a striped, cross-hatched, or other pattern or tread, or other type of textured material, for providing enhanced grip with a surface. Side runners 618 and 620 may also include a stipling pattern to enhance gripping the shooting rest 600. In some embodiments, overmolding may be employed to attach the upper extension 610 to the lower extension 612, the crossmembers 624 and 626 to the side runners 618 and 620, or any combinations thereof. Additionally, in some embodiments, protruding structural supports 629 may be provided to add enhanced structural support between the upper section 210 and the lower section 612.

Figure 9B:
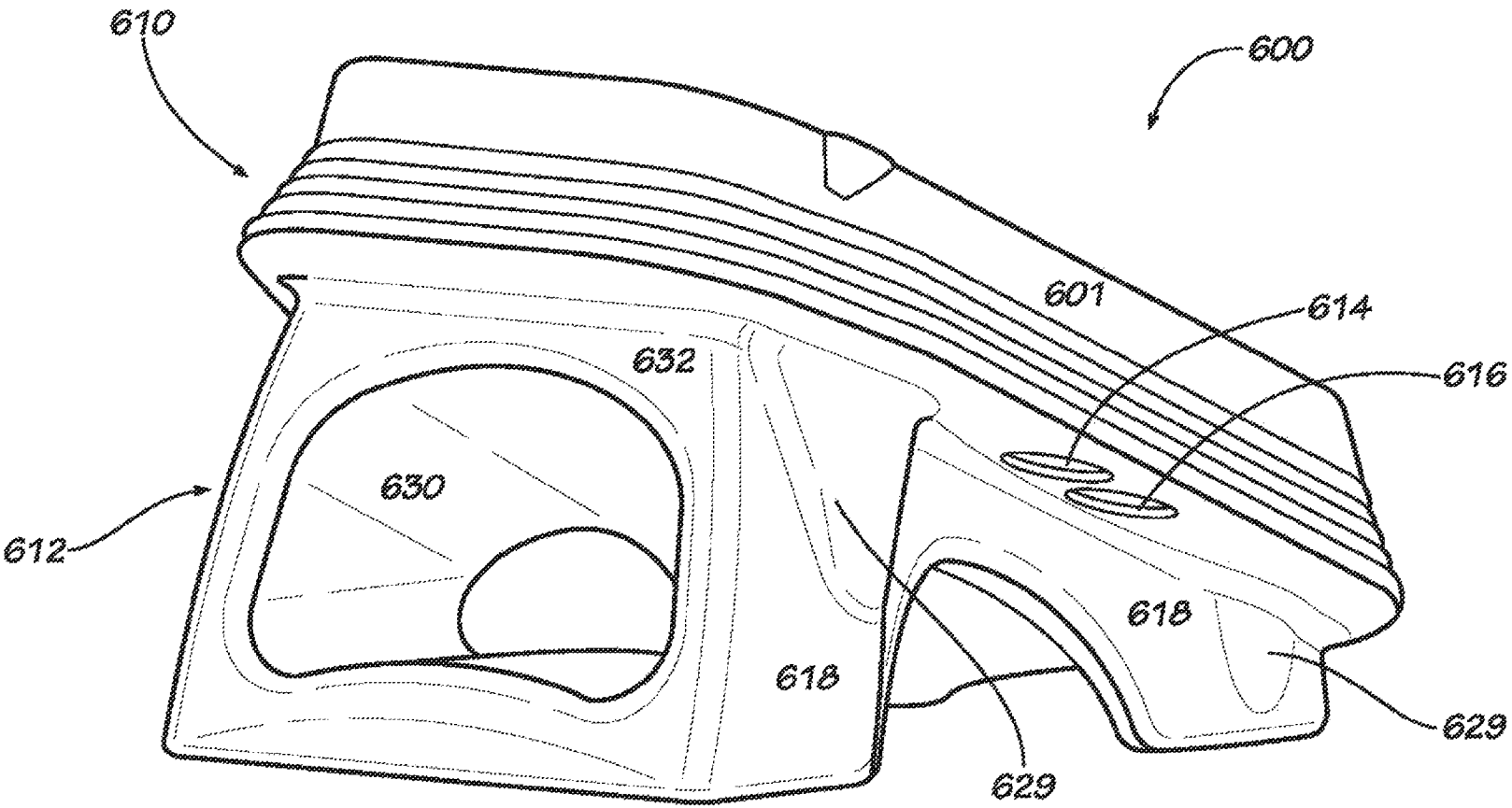
FIG. 9B is a perspective view of the monopod shooting rest according to an embodiment.

FIG. 9B further details a concave cutout 630 for reducing weight of the shooting rest 600 and for providing a space for one or more fingers to be placed when a user grabs the shooting rest 600. Additionally, as seen in FIG. 9B, a front portion 632 of the lower extension 612 may be comprised of a heel shaped support that creates the effect of a front foot for stabilizing the firearm when the magazine is in use. In some embodiments, the front portion 632 may be molded individually and then overmolded with the rest of the lower extension 612. Further, in some embodiments, the entire lower extension 612 may be molded and then a santoprene or other suitable rubber or synthetic substance may be overmolded to the bottom of the lower extension 612 to create a slip-free surface on the contact points or surface(s).

Figure 9C:
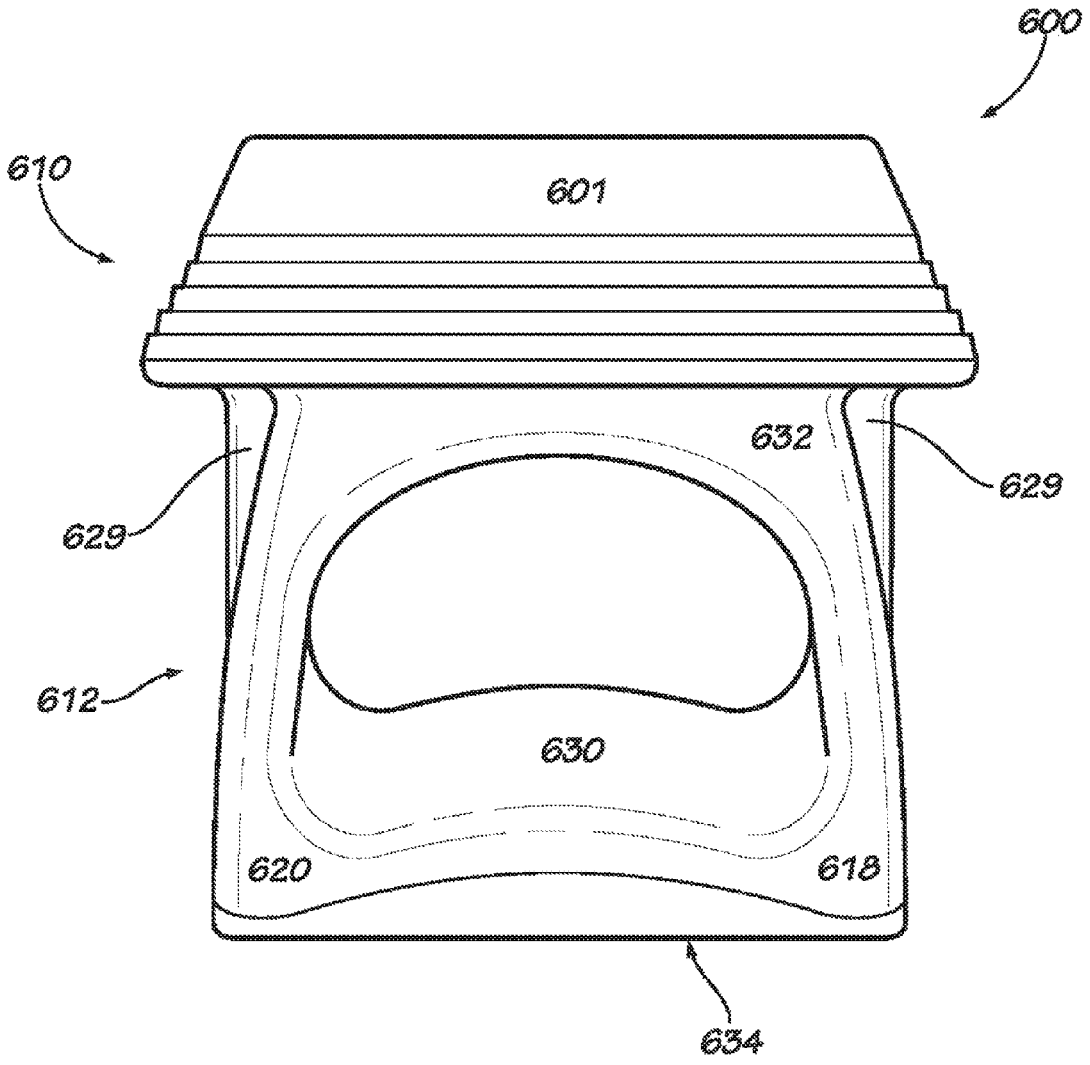
FIG. 9C is a frontal view of the monopod shooting rest according to an embodiment.
Figure 9D:
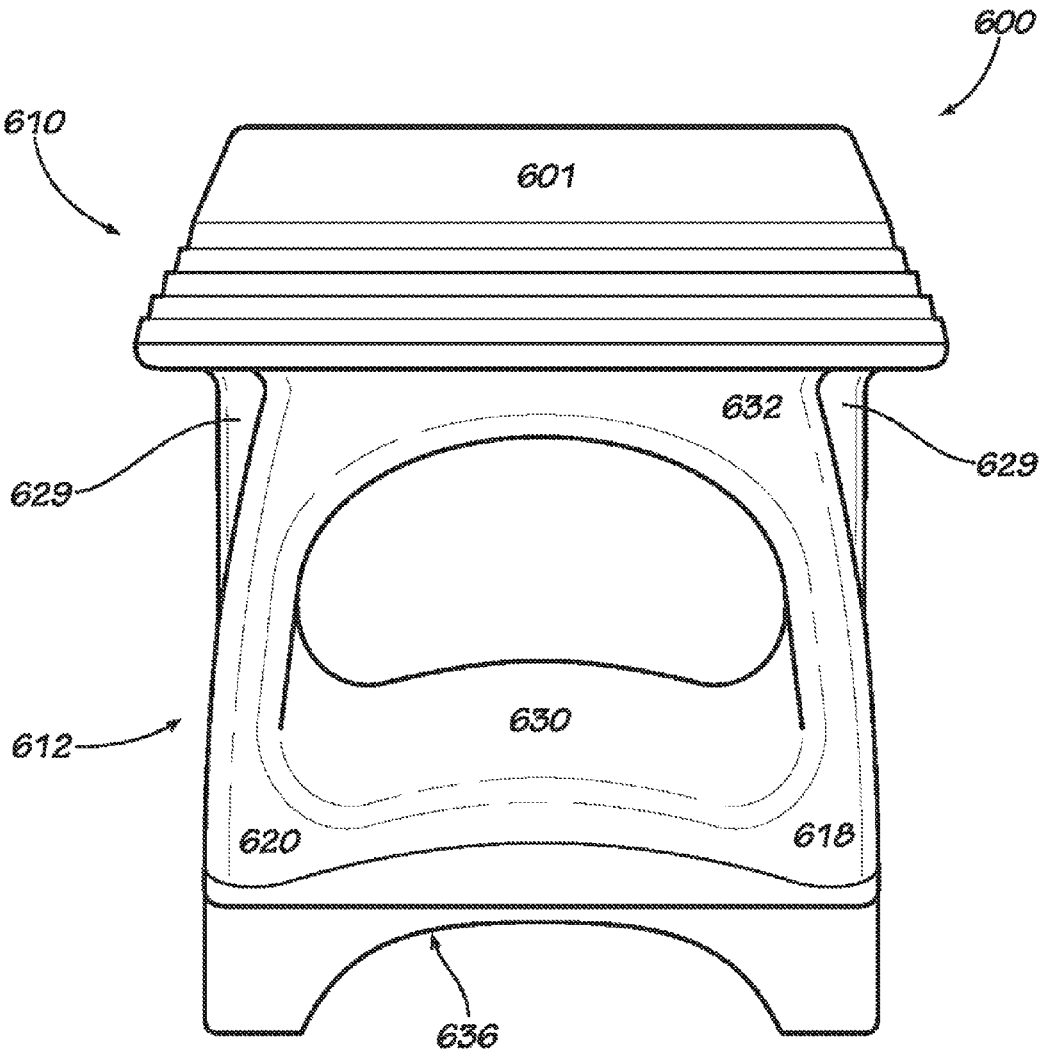
FIG. 9D is a frontal view of the monopod shooting rest according to an embodiment.

As depicted in FIG. 9C, the front portion 632 of the lower extension 612 may be formed as a flat heel 634, thereby creating the effect of three feet (contact points or surfaces), in conjunction with the two rear ends of the side runners 618 and 620, to stabilize the firearm when the magazine is in use. Alternatively, as shown in FIG. 9D, the front portion 632 of the lower extension 612 may be formed as a concave heel 636 with two feet (contact points or surfaces), thereby creating the effect of four feet (contact points or surfaces), in conjunction with the two rear ends of the side runners 618 and 620, to stabilize the firearm when the magazine is in use.

Figure 10A:
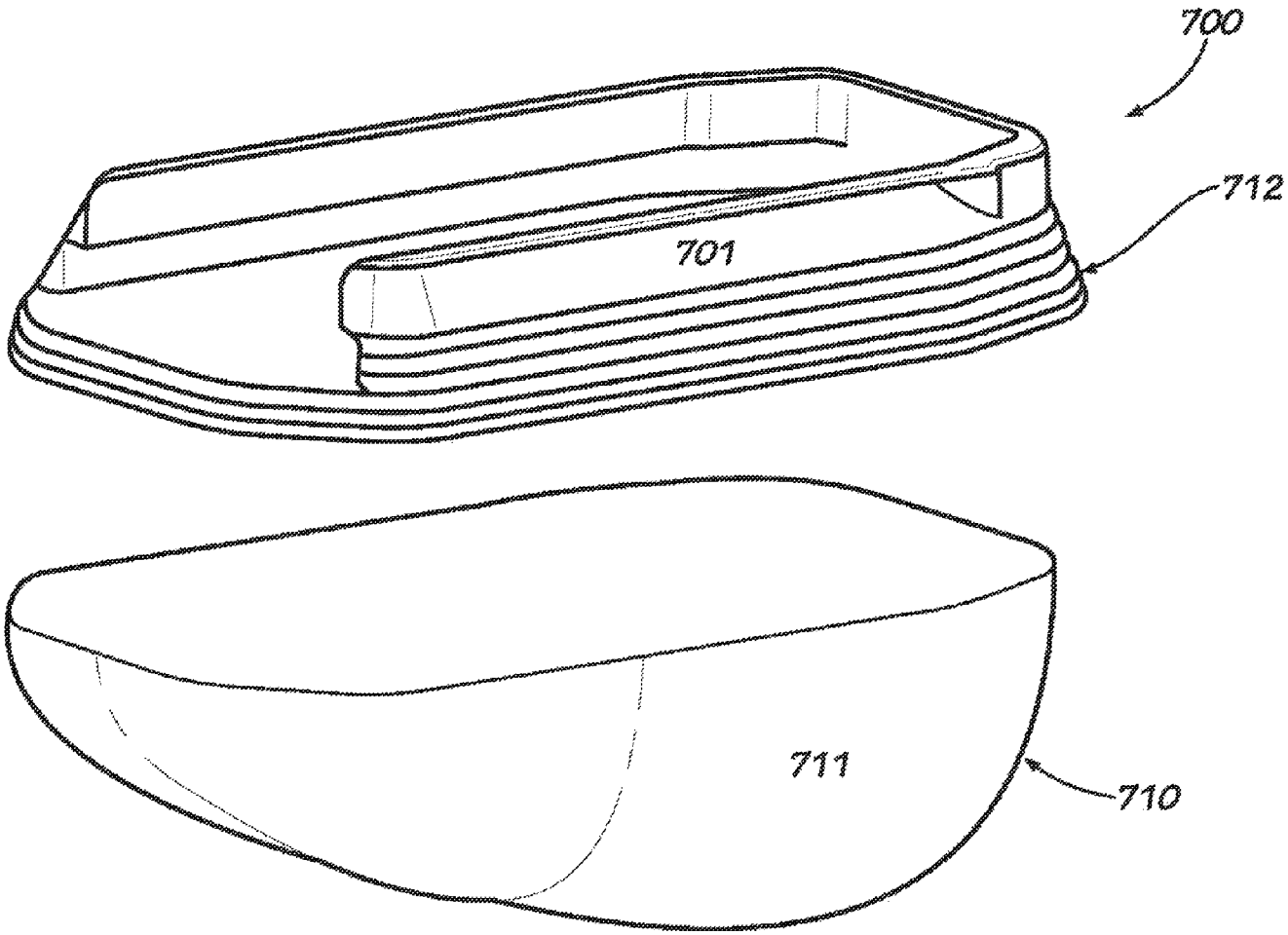
FIG. 10A is a perspective view of the monopod shooting rest according to an embodiment.
Figure 10B:
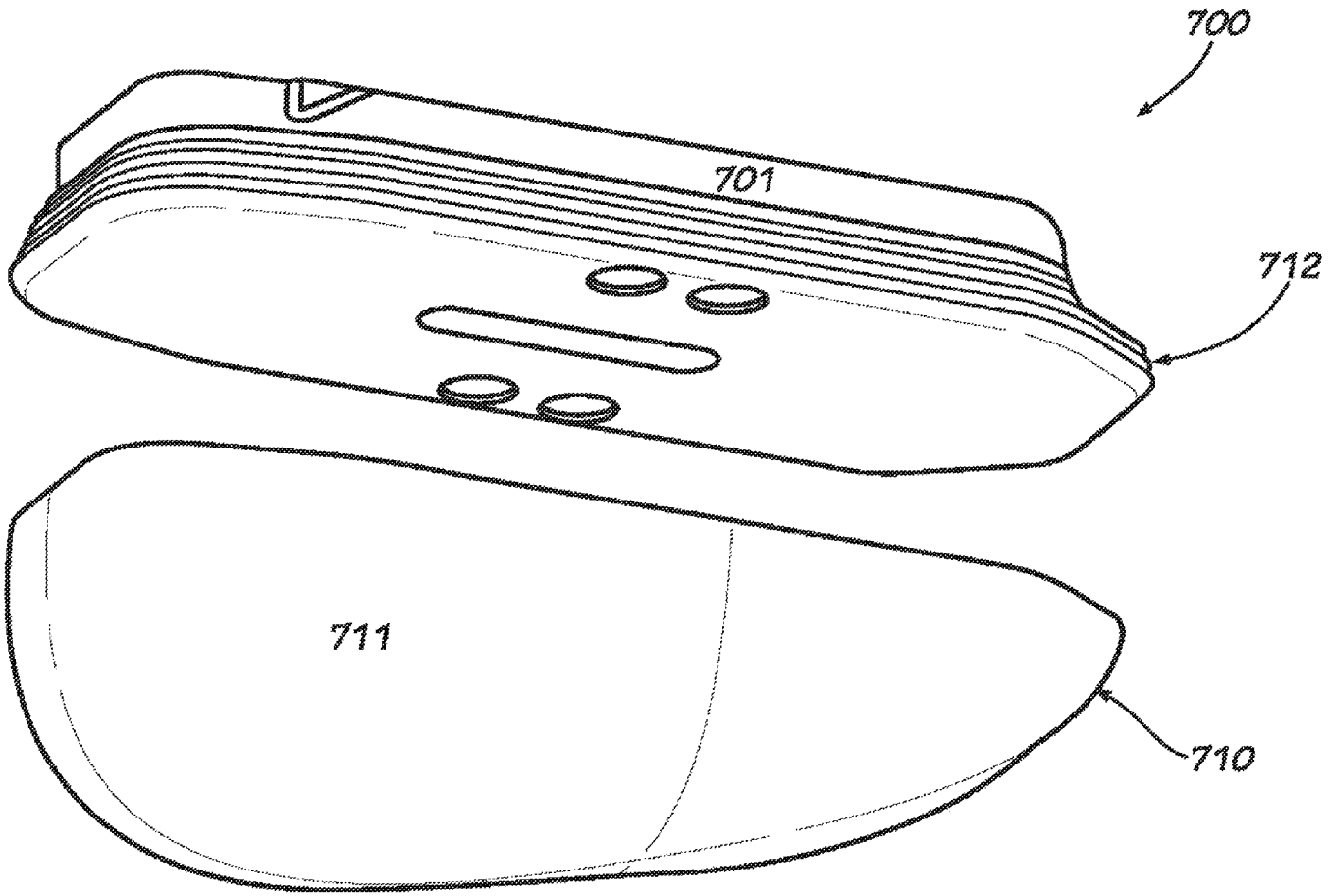
FIG. 10B is a perspective view of the monopod shooting rest according to an embodiment.

FIGS. 10A and 10B depict a shooting rest 700 in accordance with an embodiment. In this embodiment, a magazine floor coupling 701 that is substantially identical to the standard floorplate is provided, as in the embodiment of FIGS. 3A-3B. The lower extension 710 may comprise a bladder 711. In some instances, the bladder 711 may be filled with gel, foam, sand, liquid, paste, loose particles, or other material that may be pliable within a bladder, for supporting, cushioning, and/or absorbing the weight of the firearm when the magazine is in use. Additionally, the bladder 711 may be attachable to an upper extension 712 of the floor coupling 701 by any known methods such as, but not limited to, adhesive fastening methods, protruding pin fastening methods, combinations of the foregoing or the like. The bladder 711 may be coated with any suitable material, such as, but not limited to, santoprene, synthetic santoprene, silicone, rubber, or any suitable material for providing grip to a surface. Further, the bladder 711 may be overmolded using any suitable materials, such as those listed above, to the upper extension 712. Alternatively, or in addition, the bladder 711 may be formed of solid santoprene or other anti-sliding material. In some embodiments, however, the bladder 711 may be formed of a solid material, hollowed out to form a cavity within the bladder, and then filled with pegs, gels, foam, sand, liquid, paste, loose particles, pressurized air or other gas, or other material for supporting, cushioning, and/or absorbing the firearm when the magazine is in use. Further, various levels of pliability and/or deformability may be achieved for the bladder 711 by varying the type of the filler, the density of the filler, the thickness of the bladder structure 711, the thickness of the outercoating, the size of the cavity, and/or whether spacers or dividers are used within the bladder to create channels within which filler material can reside.

Figure 11A:
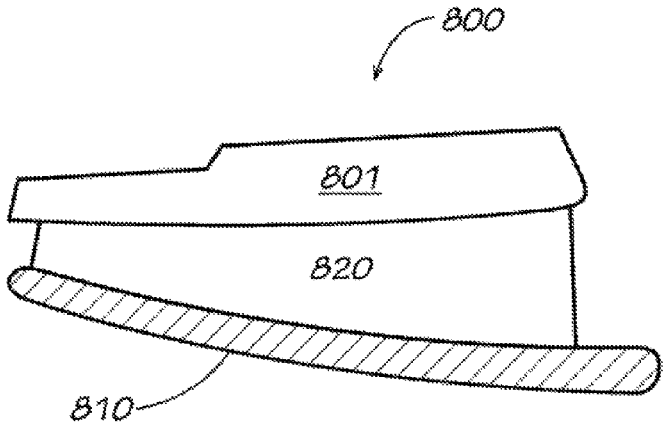
FIG. 11A is a side view of the monopod shooting rest according to an embodiment.
Figure 11B:
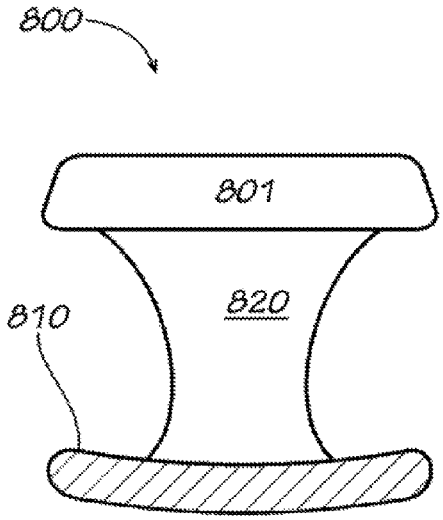
FIG. 11B is a front view of the monopod shooting rest according to an embodiment.
Figure 11C:
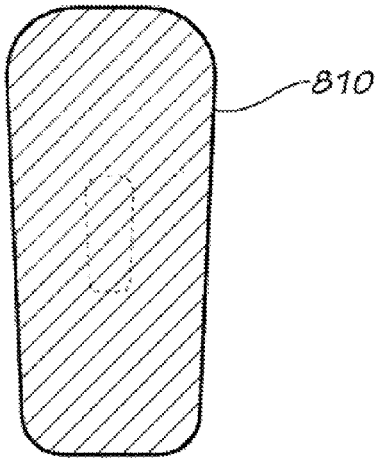
FIG. 11C is a bottom view of the monopod shooting rest according to an embodiment.

FIGS. 11A-11C depict a shooting rest 800 in accordance with an embodiment. For example, a magazine floor coupling 801 that is substantially identical to the standard floorplate is provided, as in the embodiment of FIGS. 3A-3B. In this embodiment, the lower extension 810 is connected to the magazine coupling 801 by a singular side runner 820. The lower extension 810 may be molded and then a santoprene or other suitable rubber or synthetic substance may be overmolded to create a slip-free surface on the contact points to create one large contact point rather than multiple smaller contact points. The side runner 820 is tapered equally along its entire length to form a natural grabbing point for aiding in extraction of the magazine.

Figure 12:
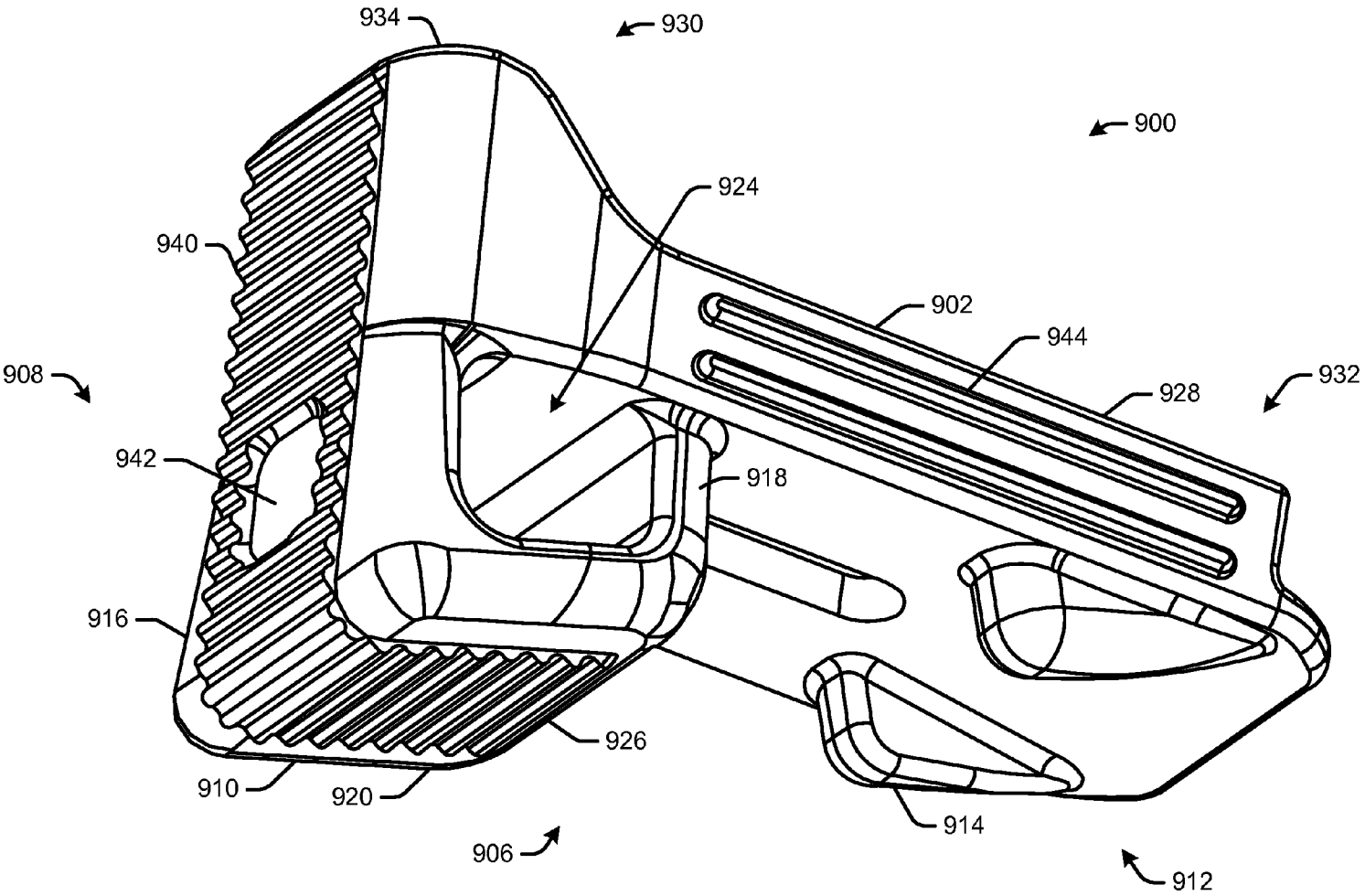
FIG. 12 is a perspective view of the monopod shooting rest according to an embodiment.

FIG. 12 depicts an example embodiment of a shooting rest 900. The shooting rest may include a magazine floor coupling 902 configured to couple to a bottom portion of a firearm magazine. The shooting rest 900 also may include a lower extension 906 extending downward from the magazine floor coupling 902. The lower extension 906 may be configured to support the magazine floor coupling 902 above a surface. In some instances, the lower extension 906 may include a forward portion 908 comprising at least one point of contact 910 for supporting or stabilizing the shooting rest 900. In addition, the lower extension 906 may include a rearward portion 912 comprising at least two points of contact 914 for supporting or stabilizing the shooting rest 900. In some instances, the at least two points of contact 914 may be laterally spaced apart triangular protrusions. The forward portion 908 may include a length greater than the rearward portion 912 so as to angle the shooting rest 900 upward.

In certain embodiments, the forward portion 908 of the lower extension 906 may include a first extension 916, a second extension 918 spaced apart from the first extension 916 (e.g., positioned behind the first extension 916), and a cross-member 920 connecting the first extension 916 and the second extension 918. The cross-member 920 may be generally transverse to the first extension 916 and second extension 918. In certain embodiments, a central beam 922 may be disposed between the first extension 916, the second extension 918, and the cross-member 920. For example, the central bean 922 may define lateral facing cutouts 924 formed between the first extension 916, the second extension 918, the cross-member 920, and the central beam 922. In some instances, a bottom surface 926 of the cross-member 920 may be at least partially texturized.

Figure 13B:
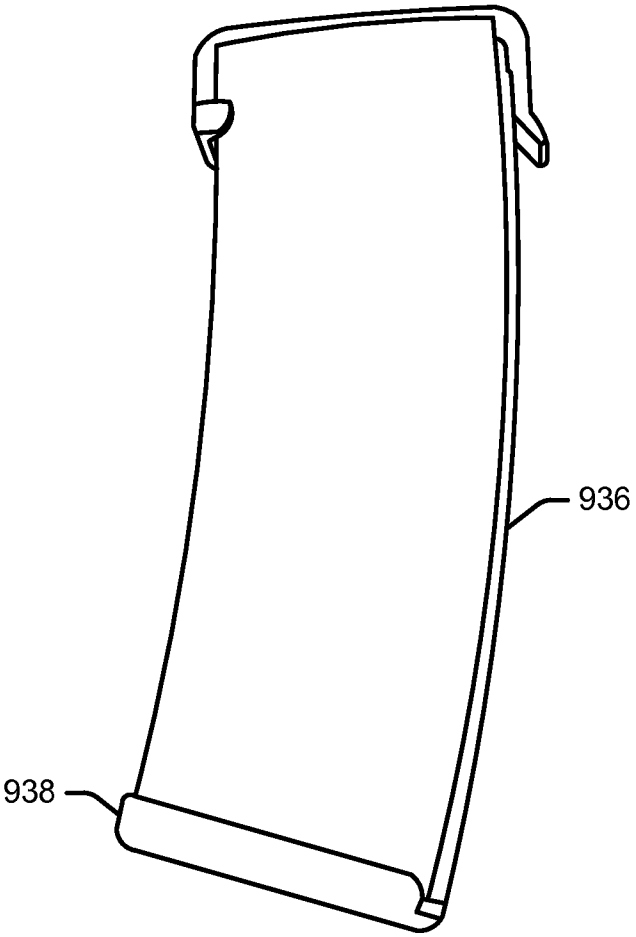
FIG. 13B is a side view of the monopod shooting rest according to an embodiment.
Figure 13A:
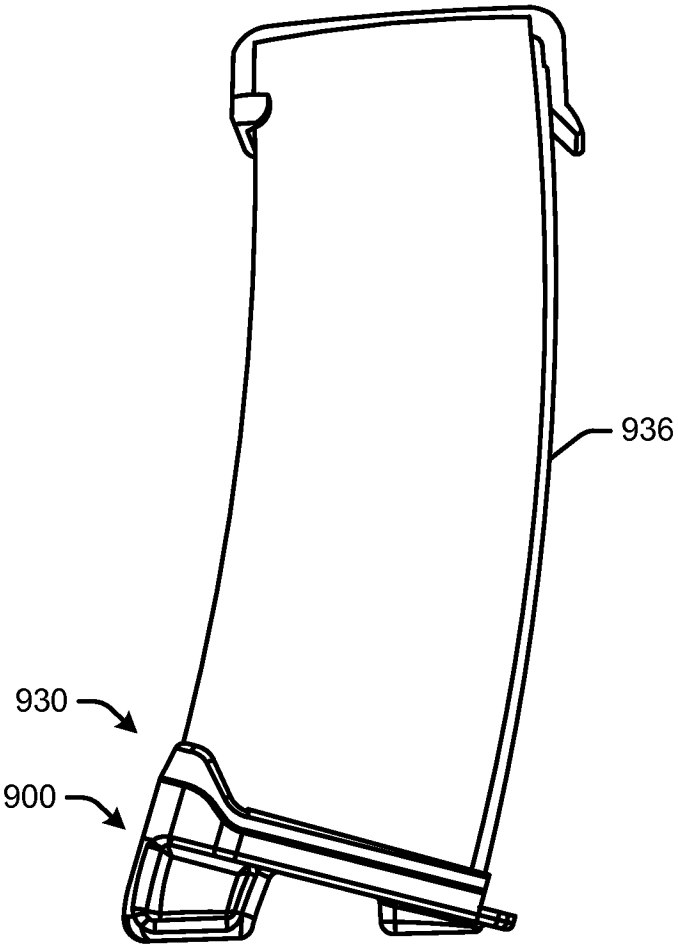
FIG. 13A is a side view of the monopod shooting rest according to an embodiment.
Figure 14:
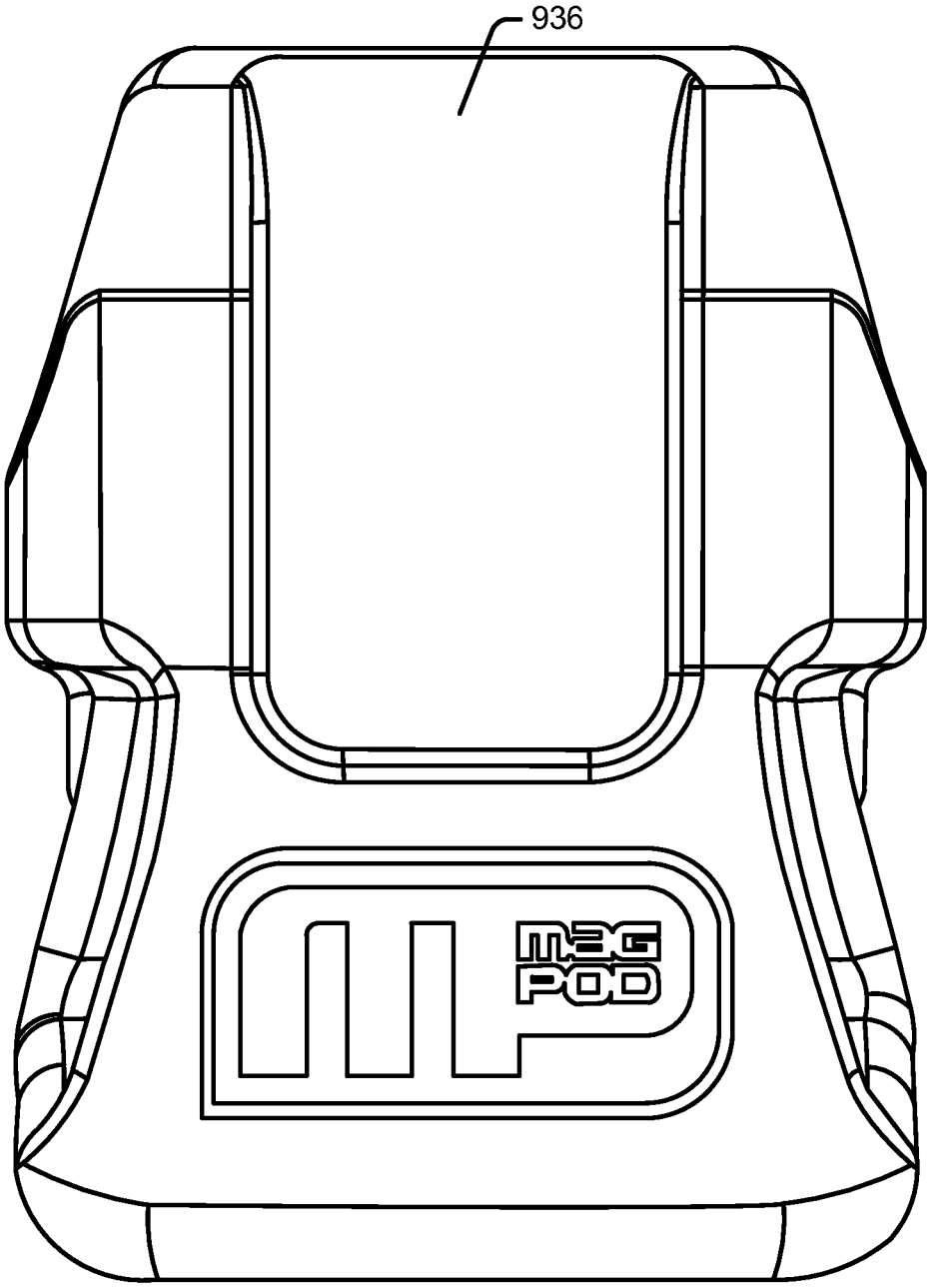
FIG. 14 is a front view of the monopod shooting rest according to an embodiment.

In some instances, the magazine floor coupling may include an upper extension 928 extending upward from the magazine floor coupling 902. The upper extension 928 may include a front section 930 and a rear section 932. In some instances, the front section 930 comprises a length greater than the rear section 932. That is, the front section 930 may include an elevated forward portion 934 that extends above the normal interface line between the magazine and the standard flat baseplate. This is depicted in FIGS. 13A and 13B. For example, FIG. 13A depicts the shooting rest 900 attached to a magazine 936, and FIG. 13B depicts a standard flat baseplate 938 attached to the magazine 936. As depicted, the front section 930 of the shooting rest 900 extends up the magazine 936. Such a configuration allows for an elongated contact area to aid in gripping and indexing the magazine 936 during a reload situation. Moreover, the front section 930 of the upper extension 928 may include a U-shaped indentation 936 as depicted in FIG. 14A. The U-shaped indentation 936 acts as an index point so the user can correctly grasp the magazine for reloading without having to visually confirm hand placement.

In FIG. 12, an enhanced gripping surface 940, such as a texturized surface, may be disposed along the front section 930 and the first extension 916. In some instances, one or more dimples 942 may be disposed about the enhanced gripping surface 940 for indexing. That is, the dimples 942 may provide a way of referencing proper hand placement for grasping the magazine without having to use visual confirmation.

Figure 15A:
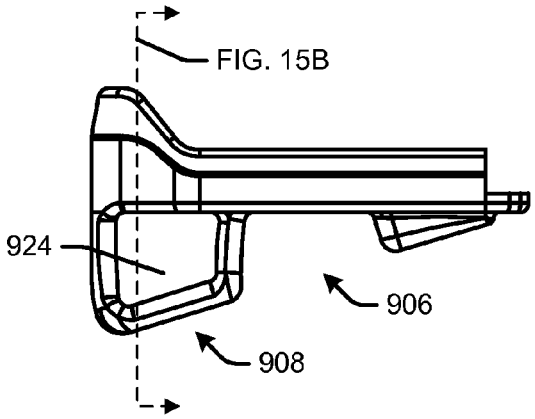
FIG. 15A is a side view of the monopod shooting rest according to an embodiment.
Figure 15B:
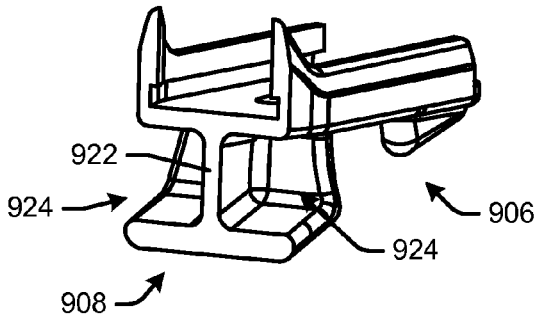
FIG. 15B is a cross-sectional perspective view of the monopod shooting rest according to an embodiment.

In some instances, the forward portion 908 of the lower extension 906 may be solid. In other instances, the forward portion 908 of the lower extension 906 may include lateral facing cutouts 924. The lateral facing cutouts 924 may extend all the way through the forward portion of the lower extension, as show in FIG. 15A. Alternatively, the central beam 922 may bisect the lateral facing cutouts into two cutouts as depicted in FIG. 15B.

The various points of contact may be made from a variety of materials, including, but not limited to, over molded materials for improved fraction, and can be replaced in case of excessive wear or damage. The side surface can have additional gripping aids, in the form of raised or textured grooves 944, dimples, or overmolded panels.

Although embodiments have been described in language specific to structural features, it is to be understood that the disclosure is not necessarily limited to the specific features described herein. Rather, the specific features are disclosed as illustrative forms of implementing the alternative embodiments described. Further, other alternative embodiments that have not be described herein may be implemented to achieve the goals of the various embodiments described.

The invention claimed is:

1. A shooting rest, comprising:

a magazine floor coupling configured to couple to a bottom portion of a firearm magazine; and a lower extension extending downward from the magazine floor coupling, wherein the lower extension comprises:

a forward portion comprising at least one point of contact for supporting or stabilizing the shooting rest, wherein the forward portion of the lower extension comprises a first extension about a front portion of the lower extension, a second extension spaced apart from the first extension towards a rear portion of the lower extension, and a cross-member connecting the first extension and the second extension, wherein the cross-member is general transverse to the first extension and second extension and forms the at least one point of contact; and a rearward portion comprising at least two points of contact for supporting or stabilizing the shooting rest.

2. The shooting rest of claim 1, further comprising a central beam disposed between the first extension, the second extension, and the cross-member.

3. The shooting rest of claim 2, further comprising lateral facing cutouts disposed about the forward portion and formed between the first extension, the second extension, the cross-member, and the central beam.

4. The shooting rest of claim 1, wherein the at least two points of contact of the rearward portion are rounded to prevent snagging.

5. The shooting rest of claim 1, wherein the magazine floor coupling comprises an aperture for seating a magazine spring guide of the firearm magazine.

6. The shooting rest of claim 1, further comprising a grasping dimple for manipulating the shooting rest.

7. The shooting rest of claim 1, wherein the at least two points of contact comprise laterally spaced apart triangular protrusions.

8. A shooting rest, comprising:

a magazine floor coupling configured to couple to a bottom portion of a firearm magazine, wherein the magazine floor coupling comprises an upper extension extending upward from the magazine floor coupling, wherein the upper extension comprises a front section and a rear section, wherein the front section comprises a length greater than the rear section, and wherein the front section comprises a forward facing U-shaped indentation; and a lower extension extending downward from the magazine floor coupling, wherein the lower extension comprises:

a forward portion comprising at least one point of contact for supporting or stabilizing the shooting rest; and a rearward portion comprising at least two points of contact for supporting or stabilizing the shooting rest.

9. The shooting rest of claim 8, wherein the forward portion of the lower extension comprises:

a first extension;

a second extension spaced apart from the first extension; and a cross-member connecting the first extension and the second extension, wherein the cross-member is generally transverse to the first extension and second extension.

10. The shooting rest of claim 9, further comprising a central beam disposed between the first extension, the second extension, and the cross-member.

11. The shooting rest of claim 10, further comprising lateral facing cutouts disposed about the forward portion and formed between the first extension, the second extension, the cross-member, and the central beam.

12. The shooting rest of claim 8, wherein the at least two points of contact of the rearward portion are rounded to prevent snagging.

13. The shooting rest of claim 8, wherein the magazine floor coupling comprises an aperture for seating a magazine spring guide of the firearm magazine.

14. The shooting rest of claim 8, further comprising a grasping dimple for manipulating the shooting rest.

15. A shooting rest, comprising:

a magazine floor coupling configured to couple to a bottom portion of a firearm magazine; and a lower extension extending downward from the magazine floor coupling, wherein the lower extension comprises:

a forward portion comprising one point of contact for supporting or stabilizing the shooting rest, wherein the forward portion of the lower extension comprises a first extension about a front portion of the lower extension, a second extension spaced apart from the first extension towards a rear portion of the lower extension, and a cross-member connecting the first extension and the second extension, wherein the cross-member is generally transverse to the first extension and second extension and forms the one point of contact; and a rearward portion comprising two points of contact for supporting or stabilizing the shooting rest.

* * * * *